US012560058B1

(12) United States Patent
Zhang et al.

(10) Patent No.: US 12,560,058 B1
(45) Date of Patent: Feb. 24, 2026

(54) AUTONOMOUS INFLOW CONTROL SYSTEMS AND METHODS

(71) Applicant: Baker Hughes Oilfield Operations LLC, Houston, TX (US)

(72) Inventors: Zhihui Zhang, Katy, TX (US); Bin Zhu, Houston, TX (US); Guijun Deng, The Woodlands, TX (US); Ronnie Russell, Cypress, TX (US); Daniel C. Ewing, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/895,742

(22) Filed: Sep. 25, 2024

(51) Int. Cl.
*E21B 43/12* (2006.01)

(52) U.S. Cl.
CPC ..... *E21B 43/12* (2013.01); *E21B 2200/02* (2020.05); *E21B 2200/05* (2020.05)

(58) Field of Classification Search
CPC ... E21B 43/12; E21B 2200/02; E21B 2200/05
See application file for complete search history.

(56) References Cited

U.S. PATENT DOCUMENTS 8,584,762 B2 * 11/2013 Fripp ..... E21B 34/08 166/381
9,683,429 B2 * 6/2017 Mathiesen ..... G05D 7/0133
9,759,042 B2 * 9/2017 Zhao ..... E21B 47/06
9,896,906 B2 * 2/2018 Tunkiel ..... E21B 34/08
10,060,221 B1 * 8/2018 Rong ..... E21B 43/12
11,549,332 B2 * 1/2023 El Mallawany ..... E21B 43/12
2015/0060084 A1 * 3/2015 Moen ..... E21B 43/08 166/321

OTHER PUBLICATIONS

Ferreira, German, Artur Sucena, Luís L. Ferrás, Fernando T. Pinho, and Alexandre M. Afonso. 2021. "Hydrodynamic. Entrance Length for Laminar Flow in Microchannels with Rectangular Cross Section" Fluids 6, No. 7: 240. https://doi.org/10.3390/fluids6070240.

* cited by examiner

*Primary Examiner* — Matthew R Buck
(74) *Attorney, Agent, or Firm* — Baker Hughes Patent Organization

(57) ABSTRACT

An autonomous inflow control system includes an inlet conduit connecting production fluid to an input of a first flow modifier including one of a laminar flow device and a turbulent flow device. An intermediate conduit is connected to a first fluid output of the first flow modifier, and connects the first flow modifier to a second flow modifier configured to provide a second fluid output, the second flow modifier including another of the laminar flow device and the turbulent flow device. The system includes a signal path configured to provide a first signal and a second signal, and a valve responsive to a difference between the first signal and the second signal. The first signal corresponds to the first fluid output and the second signal corresponds to the second fluid output, or the first signal corresponds to the input and the second signal corresponds to the first fluid output.

20 Claims, 6 Drawing Sheets

AUTONOMOUS INFLOW CONTROL SYSTEMS AND METHODS

BACKGROUND

In the resource recovery and fluid sequestration industries, particular fluids that are desired to be conveyed are often mixed with fluids that are not desired to be conveyed. The art has worked to screen out undesired fluids using viscosity based exclusion devices and alternatively density based exclusion devices. Where viscosity of the fluids is close, only the density based exclusion devices are generally used but those too have difficulty where density of the fluid is also relatively close. The art would well receive new technology that enhances conveyance of desired fluids while excluding unwanted fluids.

SUMMARY

An embodiment of an autonomous inflow control system includes an inlet conduit in fluid communication with a source of a production fluid, the inlet conduit connecting the source of the production fluid to an input of the first flow modifier, the first flow modifier including one of a laminar flow device and a turbulent flow device. The system includes an intermediate conduit connected to a first fluid output of the first flow modifier, the intermediate conduit connecting the first flow modifier to a second flow modifier configured to provide a second fluid output, the second flow modifier including another of the laminar flow device and the turbulent flow device. The system also includes a signal path configured to provide a first signal and a second signal, and a valve responsive to a difference between the first signal and the second signal. The first signal corresponds to the first fluid output and the second signal corresponds to the second fluid output, or the first signal corresponds to the input of the first flow modifier and the second signal corresponds to the first fluid output.

An embodiment of a method of controlling fluid flow includes flowing a production fluid into a first flow modifier via an inlet conduit, the first flow modifier being one of a laminar flow modifier and a turbulent flow modifier, and directing a first fluid output of the first flow modifier via an intermediate conduit to a second flow modifier, the second flow modifier in series with the first flow modifier, the second flow modifier including another of the laminar flow device and the turbulent flow device. The method includes outputting a second fluid output from the second flow modifier, directing a first pressure signal via a first signal path to a valve, directing a second pressure signal via a second signal path to the valve, and automatically opening or closing the valve responsive to a pressure difference between the first pressure signal and the second pressure signal. The first pressure signal corresponds to the first fluid output and the second pressure signal corresponds to a second fluid output from the second flow modifier, or the first pressure signal corresponds to the input of the first flow modifier and the second pressure signal corresponds to the first fluid output;

An embodiment of a borehole system includes a borehole in a subsurface formation, a string in the borehole, and an autonomous inflow control system including an inlet conduit in fluid communication with a production fluid in the subsurface formation, the inlet conduit connecting the subsurface formation to an input of a first flow modifier, the first flow modifier including one of a laminar flow device and a turbulent flow device. The inflow control system includes an intermediate conduit connected to a first fluid output of the first flow modifier, the intermediate conduit connecting the first flow modifier to a second flow modifier configured to provide a second fluid output, the second flow modifier including another of the laminar flow device and the turbulent flow device, a signal path configured to provide a first pressure signal and a second pressure signal, and a valve responsive to a pressure difference between the first pressure signal and the second pressure signal. The first pressure signal corresponds to a first pressure of the first fluid output and the second pressure signal corresponds to a second pressure of the second fluid output, or the first pressure signal corresponds to the input of the first flow modifier and the second pressure signal corresponds to the first fluid output.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Devices, systems and methods are provided herein for controlling fluid flow, such as controlling fluid flow in a borehole system. An embodiment of an autonomous or automatic inflow control system includes a first flow modifier in fluid communication with a downhole fluid, and a second flow modifier in series with the first flow modifier. In an embodiment, the first flow modifier is or includes a laminar flow device, and the second flow modifier is or includes a turbulent flow device. In another embodiment, the first flow modifier is or includes a turbulent flow device, and the second flow modifier is or includes a laminar flow device.

The system also includes a flow control device, such as a shuttle valve, that automatically opens or closes based on a differential pressure. The differential pressure is a difference between an output pressure from the laminar flow device and an output pressure from the turbulent flow device. A change in the differential pressure (e.g., due to production fluid switching between oil and water, or a proportion of oil and water changing) actuates the flow control device to increase or decrease a flow rate of production fluid into a main production fluid flow.

The downhole fluid may be a fluid or fluids extracted or received from a subterranean region, such as a hydrocarbon-bearing formation. The autonomous flow control system may be part of a drill string, production string or other downhole component.

Embodiments described herein present a number of advantages. Embodiments provide effective mechanisms for automatically adjusting production fluid flows based on changes between downhole fluids, particularly downhole fluids that have the same or similar viscosity. The embodiments represent improvements to existing flow control systems, which are based on viscosity.

For example, high water production often exists in mature wells undergoing water flooding. Conventional inflow control devices are viscosity based, and perform well in reservoirs where water and oil viscosity are significantly different, but are unable to effectively choke the flow of water when the water and a hydrocarbon fluid have the same or similar viscosity, and have a similar density (e.g., a density difference of 15% or less, such as 10% or less). Such situations occur, for example, in light oil reservoirs where water and oil viscosity are similar. Embodiments describe herein address such limitations.

Figure 1:
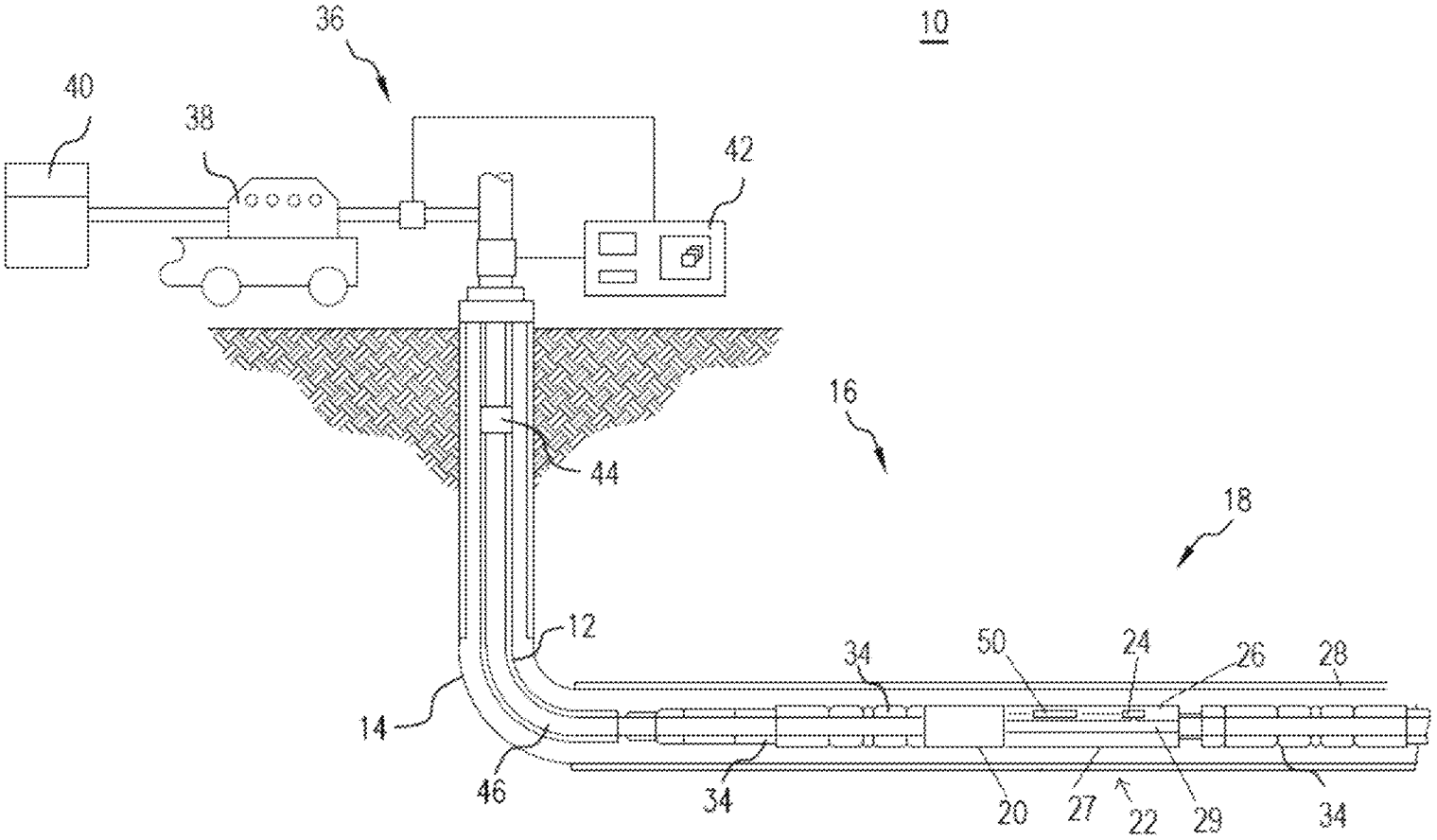
FIG. 1 is a view of a borehole system including an autonomous inflow control system as disclosed herein.

FIG. 1 depicts an example of a downhole system 10 configured to perform a subterranean operation. The downhole system 10 in this example is a resource or energy production system 10 that includes a borehole string 12 disposed in a borehole 14 extending into a subterranean region or a resource bearing formation, such as an earth formation 16. It is noted that the autonomous inflow control system described herein is not limited to this example, and can be incorporated into any suitable downhole device or component.

The borehole string 12 includes a completion string that extends through a casing 28 and includes a production assembly 18. The production assembly 18 includes a screen assembly 20, and an autonomous inflow control system 22 configured to automatically control the flow of production fluids into the borehole string 12 based on factors including changes in viscosity. For example, the inflow control system 22 controls the flow of fluid from the screen assembly 20. The inflow control system 22 includes a valve 24, such as an inflow control device (ICD), disposed in an inner annulus 26 of a body 27 of the inflow control system 22. The ICD or valve 24 is in fluid communication with production fluid from the screen assembly 20, and is in fluid communication with a production bore 29.

As described herein, "production fluid" is any fluid or combination of fluids (e.g., water, gas and/or oil) extracted from the earth formation 16. Production fluid may also include fluids injected into the borehole string 12 and/or the borehole 14. In an example, as shown in FIG. 1, the borehole string 12 includes a main production conduit 46 (e.g., bore) for flowing production fluid to the surface.

The inflow control system 22 also includes a flow modification system 50 configured to automatically control the valve 24 based on changes in viscosity of production fluid. The flow modification system 50 receives production fluid from the formation 16 via an inlet or port 32 (referred to herein as a "pilot port" 32). The flow modification system 50 controls the valve 24 based on a pressure differential between a laminar flow and a turbulent flow of production fluid, as discussed further herein.

The production assembly 18 may include additional components, such as one or more packer assemblies 34 configured to isolate components and/or zones in the borehole 12. For example, the packer assemblies 34 are activated to isolate a section of the borehole 14 that includes the production assembly 18 and the inflow control system 22.

The system 10 also includes surface equipment 36 such as a drill rig, rotary table, top drive, blowout preventer and/or others to facilitate deploying the borehole string 12, operating various downhole components, monitoring downhole conditions and controlling fluid circulation through the borehole 14 and the borehole string 12. For example, the surface equipment 36 includes a fluid control system 38 including one or more pumps in fluid communication with a fluid tank 40 or other fluid source. The fluid control system 38 facilitates injection of fluids, drilling fluid (e.g., drilling mud), stimulation fluid (e.g., a hydraulic fracturing fluid), gravel slurries, proppant, and others.

One or more components of the borehole string 12 may be configured to communicate with a surface location (e.g., the surface equipment 36). The communication may be wired or wireless. A processing device, such as a surface processing unit 42 and/or a subsurface processing unit 44, may be operably connected to surface and/or downhole components.

Figure 2:
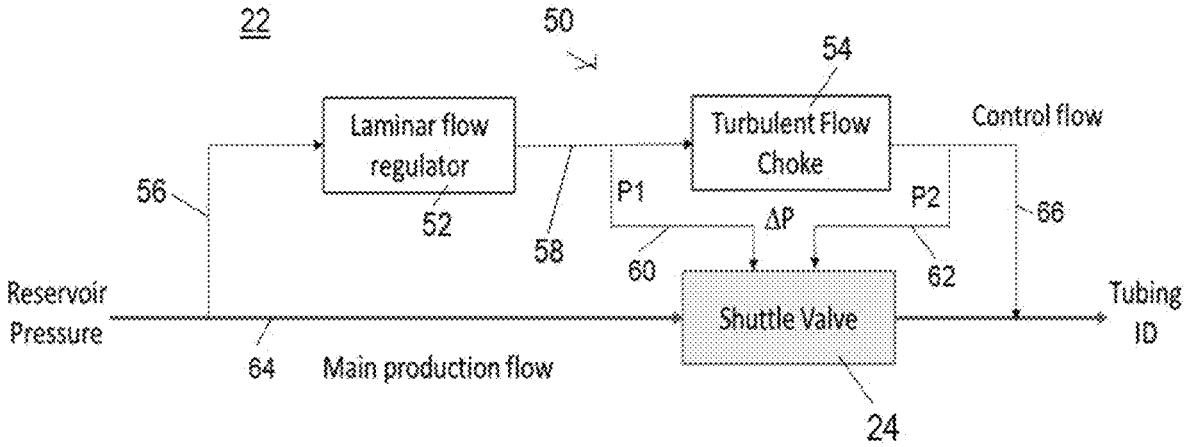
FIG. 2 is a schematic illustration of an autonomous inflow control system as disclosed herein.

FIG. 2 schematically depicts an embodiment of the autonomous inflow control system 22, which includes a first flow modifier 52 configured to receive a portion of production fluid from a subterranean region, such as the formation 16, and output the portion of the production fluid to a second flow modifier 54. The flow modifiers function to create a pressure drop in received fluid and thereby modify fluid flow by modifying fluid pressure.

In an embodiment, the first flow modifier 52 is configured as a laminar flow device or regulator, and the second flow modifier 54 is configured as a turbulent flow device or choke. Embodiments are not so limited, as the first flow modifier 52 may be configured as a turbulent flow device, and the second flow modifier 54 may be configured as a laminar flow device.

The control system 22 includes a first fluid conduit 56, also referred to as an inlet conduit 56, which receives the portion of the production fluid (e.g., via the pilot port 32) and directs the portion to the first flow modifier 52. A second fluid conduit 58 (also referred to as an intermediate conduit 58) fluidly connects the flow modifiers in series, and directs a first fluid output having a pressure P1 from the first flow modifier 52 to the second flow modifier 54. In an embodiment, the first fluid output is a laminar flow of the fluid received from the inlet conduit 56.

The first fluid output is directed to the second flow modifier 54 through the second intermediate conduit 58, which produces a second fluid output having a pressure P2. In an embodiment, the second flow modifier 54 receives a laminar flow and converts the laminar flow to turbulent flow.

Generally, a laminar flow device is configured to create a pressure drop using a laminar flow. Laminar flow can be represented by the Reynolds number, and the laminar flow modifier includes one or more flow channels, in which the number, length and cross-sectional shape of such flow channels are selected to have a Reynolds number corresponding to laminar flow. A low Reynolds number is indicative of laminar flow. For example, the first flow modifier 52 has a Reynolds number that is less than about 2300.

A turbulent flow device creates a pressure drop using nonlaminar flows, or turbulent flows. An example of a turbulent flow device is a hydrocyclone. Other examples include but are not limited to an orifice, venturi nozzle, or a tortuous flow channel that causes turbulence in a fluid. For example, the second flow modifier 54 has a Reynolds number of greater than about 2300.

The first fluid output pressure P1 is used to create a first pressure signal, which is transmitted via a first signal path 60 to the valve 24, and the second fluid output pressure P2 is used to create a second pressure signal, which is transmitted via a second signal path 62 to the valve 24. A result is a differential pressure signal ΔP, where ΔP is equal to a difference between P1 and P2. The valve 24 is configured to open or close based on a selected threshold value of the differential pressure signal ΔP. For example, the valve 24 is configured to close to choke off fluid flow to a main production flow 64 (or partially close to restrict fluid flow) if ΔP meets or exceeds the threshold value. In an example, the main production flow is through the production bore 29.

The selected threshold value of ΔP may be any suitable value (e.g., about 20 psi or greater, such as about 25 psi), which can be calibrated based on, for example, expected types of hydrocarbons (e.g., calibrated to account for and respond to different types of light oil). In another example, the selected threshold value corresponds to a pressure drop between the inlet conduit 56 and an outlet conduit 66 (e.g., the threshold value is selected to be about 50% of the pressure drop).

In an embodiment, the pressure signals are hydraulic signals, and the signal paths 60 and 62 are fluid lines or conduits. In this embodiment, the first pressure signal is generated by diverting part of the first flow output to the first signal path 60, and the second pressure signal is generated by diverting part of the second flow output to the second signal path 62. The remaining fluid is flowed back to a production flow 64 (e.g., the production bore 29 of the borehole string 12) via the outlet conduit 66.

The first and second flow modifiers direct the first and second pressure signals to the valve 24. If there is a sufficient difference ΔP between the pressure signals P1 and P2 (at least a threshold pressure difference), the valve 24 is operated or moved response to the pressure difference. For example, an increase in ΔP due to the production fluid becoming all or mostly water (or the production fluid having at least a proportion of water to hydrocarbon) causes the valve 24 to close and choke off flow of production fluid into a borehole string or production string.

The threshold pressure difference ΔP may be selected or calibrated based on factors that include parameters of the first flow modifier 52 and the second flow modifier 54 (e.g., length, pressure drop, etc.), as well the pressure drawdown between the formation and production tubing or other production fluid conduit. Other factors that may be considered include the density and viscosity variation between oil and water.

In an embodiment, the first flow modifier 52 is configured as a turbulent flow device, and the second flow modifier 54 is configured as a laminar flow device. In this embodiment, pressure signal P1 corresponds to an output pressure from the turbulent flow device and P2 corresponds to an output pressure from the laminar flow device.

Although the pressure differential signal is described as pressure signals carried by fluid outputs, embodiments are not so limited. For example, the pressure of the fluid outputs may be converted into an electrical signal and used to control an electrical valve. In another example, fluid outputs may be directed to mechanical assemblies that convert pressures to mechanical forces operable to move a valve. The valve may be a proportional valve or a directional (on/off) valve. For example, the valve may be an on/off valve, such as a bi-directional shuttle valve, or a proportional valve having a diaphragm.

Figure 3:
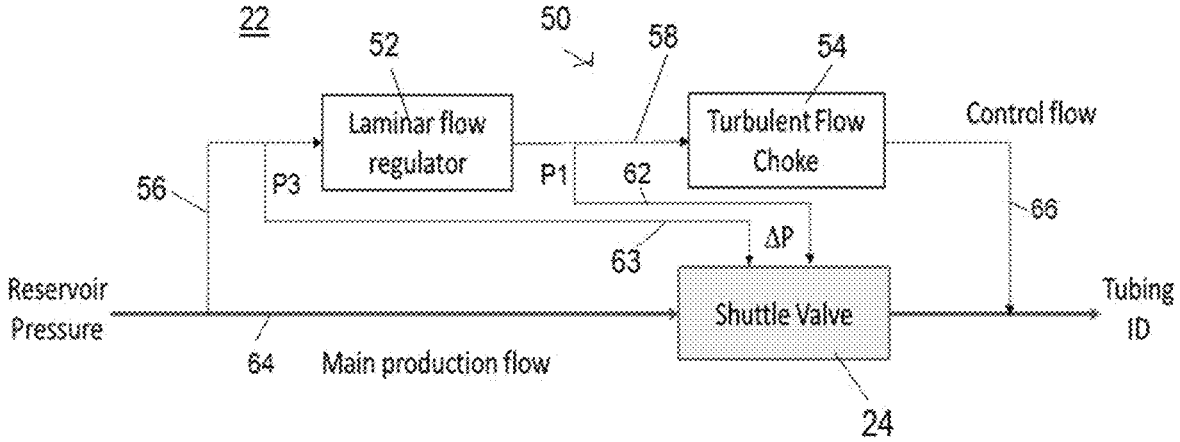
FIG. 3 is a schematic illustration of an autonomous inflow control system as disclosed herein.

FIG. 3 depicts an embodiment of the autonomous inflow control system 22. The first pressure signal corresponds to an input pressure P3 to the first flow modifier 52, which is transmitted via a signal path 63 to the valve 24. The second pressure signal corresponds to the fluid output pressure P1, which is transmitted via the second signal path 62 to the valve 24. In this embodiment, ΔP is equal to a difference between P1 and P3.

Figure 4:
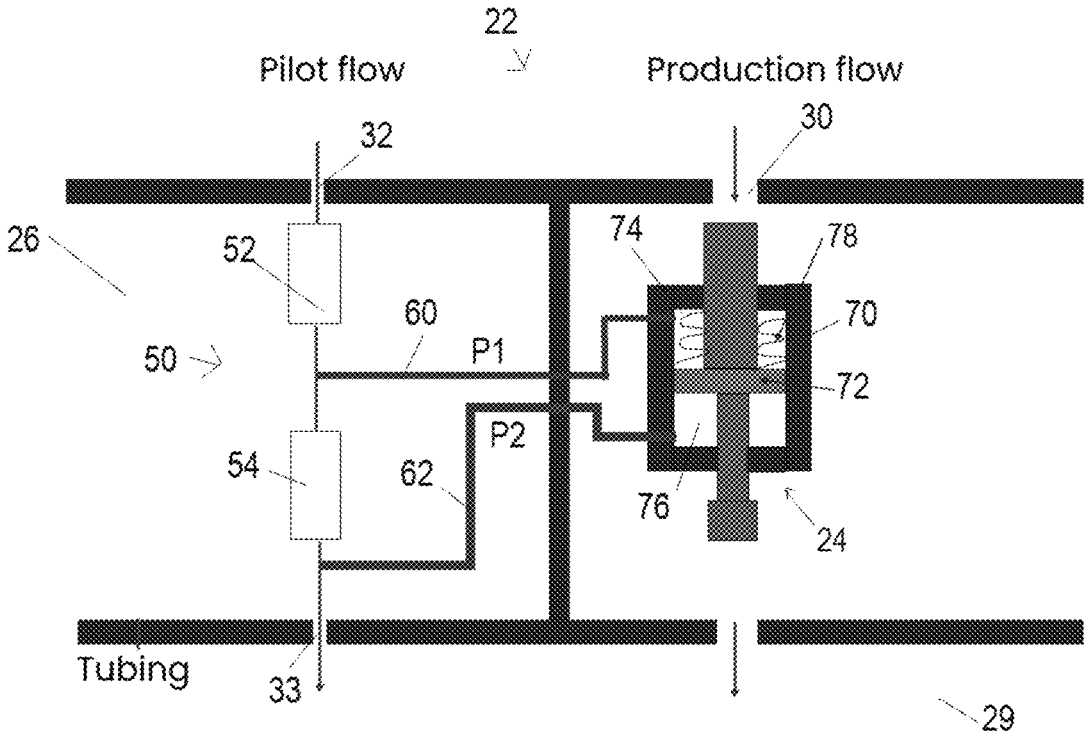
FIG. 4 is an embodiment of the autonomous inflow control system of FIG. 2, as incorporated in a borehole system.
Figure 5:
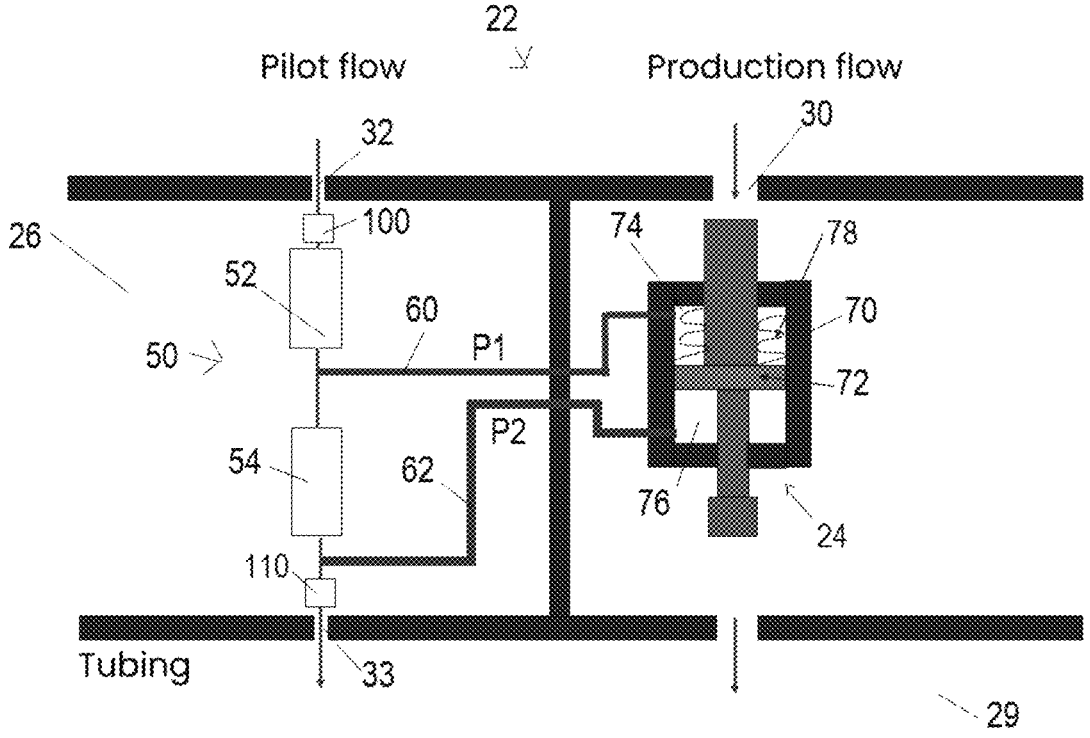
FIG. 5 is an embodiment of the autonomous inflow control system of FIG. 2, as incorporated in a borehole system and including at least one pressure regulator.

FIGS. 4 and 5 depict examples of a configuration of the autonomous inflow control system 22, as incorporated into an annulus. These examples are discussed in conjunction with the borehole system of FIG. 1, but is not so limited.

In these examples, the valve 24 is a hydraulically actuated valve, such as a shuttle valve 24, which is in fluid communication with an inlet or port 30 (referred to as a "production port" 30). The valve 24 is not so limited, and may be any suitable type of valve (e.g., on/off or proportional).

The shuttle valve 24 includes a housing 70, and a moveable piston 72 that separates the housing volume into chambers 74 and 76. A sufficient pressure difference ΔP causes the piston 72 to move due to the relative changes in volume of the chambers 74 and 76. A biasing element 78, such as a spring, may be included.

The differential pressure causes the shuttle valve 24 to open or close (fully or partially). For example, if a proportion of water to a hydrocarbon (e.g., a hydrocarbon having a low viscosity, such as light oil having a viscosity of 10 centipoise (cP) or less) in the production fluid increases, and P1 is sufficiently greater than P2 (e.g., greater than a threshold difference, such as 20 psi), the piston 72 is moved upward to choke flow of fluid through the production port 30. In this way, a relatively small change in viscosity, such as a change due to transition from water to light oil, can be autonomously reacted to in order to maximize the flow of hydrocarbons in the production fluid.

In the example of FIG. 5, the inflow control system 22 includes one or more pressure regulators configured to adjust or regulate inlet pressure (i.e., pressure of fluid upstream of the flow modification system 50) and/or adjust or regulate outlet pressure (i.e., pressure of fluid downstream from the flow modification system 50).

The one or more pressure regulators include, for example, an inlet pressure regulator 100 that reduces the pressure of fluid flowing through the pilot port 32 from an initial pressure to a desired pressure. For example, the inlet pressure regulator 100 reduces the fluid pressure from an initial pressure (e.g., 150 psi) to an operating pressure (e.g., 50 psi).

In addition, or alternatively, the inflow control system 22 includes an outlet pressure regulator 110, which is used to increase the pressure of fluid downstream of the flow modification system 50.

Figure 6:
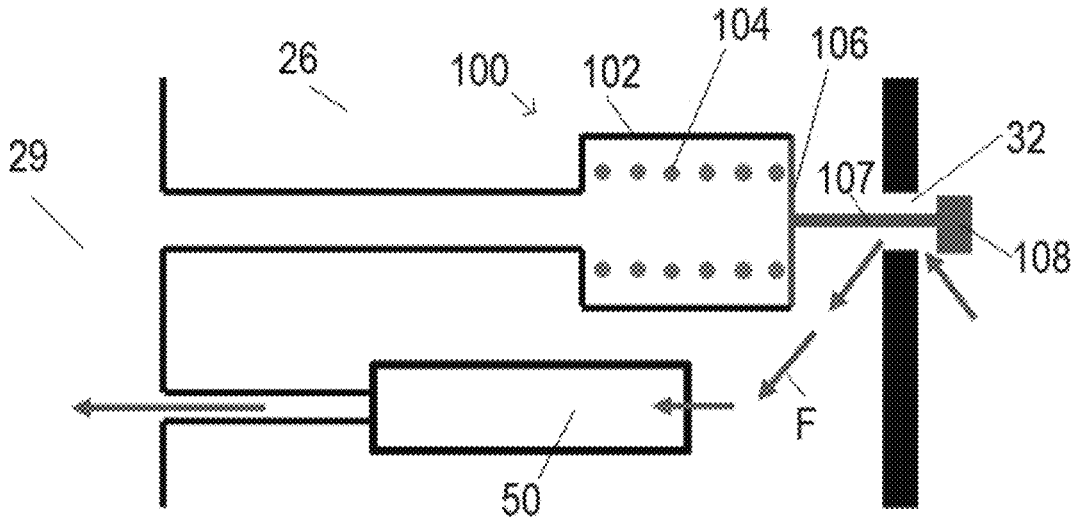
FIG. 6 depicts an example of an inlet pressure regulator.

FIG. 6 depicts an example of the inlet pressure regulator 100, which includes a chamber 102 disposed proximate to the pilot port 32. The chamber 102 houses a loading spring 104 and supports a diaphragm 106. The chamber 102 may be in fluid communication with the production bore 29. The loading spring 104 may be adjusted to calibrate pressure regulation. A valve stem 107 connects a plug or head 108 to the diaphragm 106. Pressure exerted on the diaphragm 106 causes the head 108 to move into the pilot port 32 and cause a reduction in pressure of fluid (denoted by arrows F).

Figure 7:
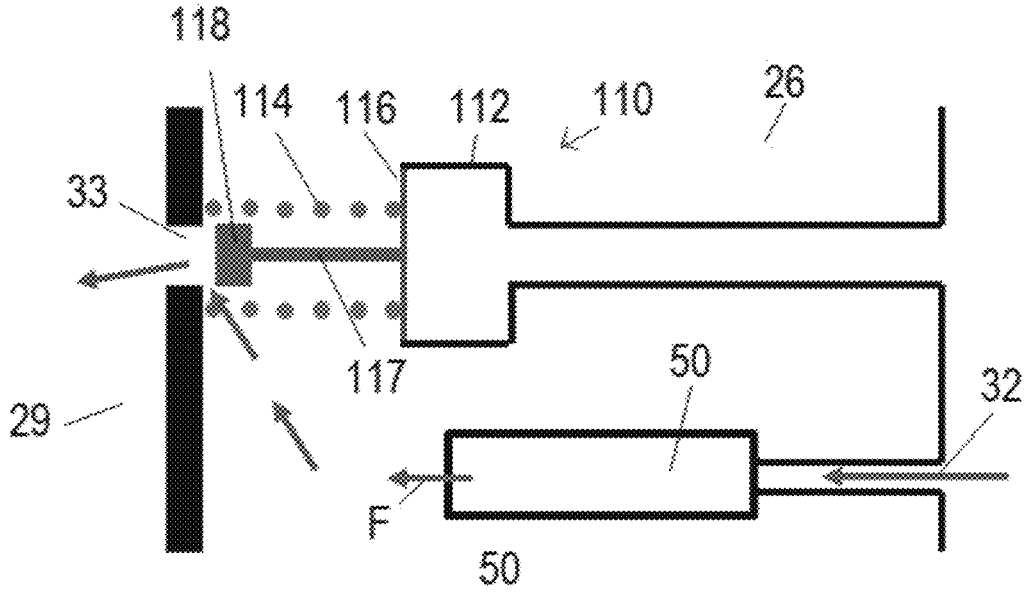
FIG. 7 depicts an example of an outlet pressure regulator.

FIG. 7 depicts an example of the outlet pressure regulator 110, which includes a chamber 112 disposed proximate to the outlet port 33. The chamber 112 may be in fluid communication with production fluid. The chamber 112 supports a loading spring 114 and a diaphragm 116. The loading spring 114 may be adjusted to calibrate pressure regulation. A valve stem 117 connects a plug or head 118, and pressure exerted on the diaphragm 106 causes the head 108 to move toward the outlet port 33 and to restrict flow therethrough. The outlet pressure regulator 110 is advantageous, for example, because the head 118 does not enter into the outlet port when in operation, or extend into the production bore 29. The following is a discussion of the mechanism and principle by which the inflow control system 22 autonomously operates. Equation (1) represents an individual pressure drop ΔP1 for a laminar flow device having a circular fluid channel, Equation (2) represents an individual pressure drop ΔP1 for a laminar flow device having a rectangular fluid channel. Equation (3) represents an individual pressure drop ΔP2 for a turbulent flow device:

$$\frac{\Delta P_1}{L} = c_1 \frac{\mu Q}{D_h^4} \tag{1}$$

$$\frac{\Delta P1}{L} = \frac{12}{w}\frac{\mu Q}{h^3} \tag{2}$$

$$\frac{\Delta P2}{L} = c_2 f_D \frac{\rho Q^2}{D_h^5}. \tag{3}$$

In the above equations, L is a length of a flow conduit, Q is volume flow rate through a device, μ is viscosity, $D_h$ is a hydraulic diameter of a flow conduit, and p is fluid density. For equation (2), w and h are the width and height of the rectangular fluid channel, respectively. $C_1$ and $C_2$ are geometric constants, and $f_D$ is a coefficient related to Re number, geometry and surface finish.

As seen in Equation (1) or (2), when switching between fluids of the same or similar viscosity (e.g., oil and water of the same viscosity) by a laminar flow device, there is no density term, and thus the pressure drop ΔP1 does not change when switching between the fluids provided that the flow rate Q is identical. However, there is a density dependence in Equation (3) for a turbulent flow device, as switching between fluids leads to change of the flow rate Q. Thus, when a laminar flow device and a turbulent flow device are connected in series, both ΔP1 and ΔP2 change when switching between oil and water due to the flow rate continuity. Thus, a control signal can be generated from either the laminar flow device or the turbulent flow device responding to an oil and water switch solely based on density. The control signal can be further enhanced from a viscosity variation if occurring during an oil and water switch.

A laminar flow modifier includes one or more internal channels, each of which has a length, shape and size configured to cause fluid flow therethrough to transition to a laminar flow. Generally, the internal channels are configured so that a hydraulic diameter of a channel is related to an area equivalent diameter, such that the Reynolds number is below 2300 (or other suitable value). An "area equivalent diameter" of a circular channel is the diameter of the cross-sectional circular area (geometric diameter). For a non-circular channel, the area equivalent diameter is the diameter of a circular cross-section that gives the same cross-sectional area of the non-circular channel.

For a circular channel, the hydraulic diameter ($D_h$) is the same as the geometric diameter of the channel.

The hydraulic diameter ($D_h$) of a general geometry with constant cross-section, such as a non-circular channel or circular annulus, is defined by the following equation:

$$D_h=(4A)/P, \tag{4}$$

where A is the area and P is the wetted perimeter of the circular channel.

The area equivalent diameter ($D_a$) is defined as the geometric cross-sectional area of the circular channel, represented by the following equation:

$$D_a=\sqrt{(4A/\pi)}. \tag{5}$$

For a non-uniform (i.e., the cross-sectional shape is not constant over length) and/or complex non-circular channel, the hydraulic diameter is defined by the following equation:

$$D_h=(4V)/S, \tag{4}$$

where V is the total wetted volume of the channel, and S is the total wetted surface area (this equation reduces to 4A/P for a uniform non-circular cross-section). FIGS. 8A-8D depict various embodiments of a laminar flow device 80, which may be incorporated into the inflow control system 22. For example, the laminar flow device 80 is the first flow modifier 52 or the second flow modifier 54.

In each of FIGS. 8A-8D, the laminar flow device 80 includes a plurality of channels 82 extending longitudinally through the device 80. The channels may extend linearly or non-linearly (e.g., in a curved or spiral path).

Figure 8A:
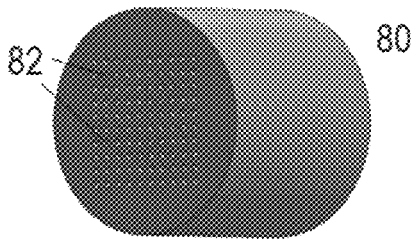
FIGS. 8A-8D depict embodiments of a laminar flow modifier including various internal channel configurations.
Figure 8B:
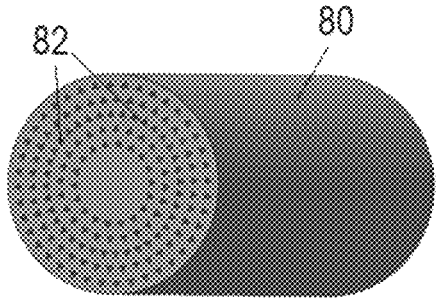
Figure 8C:
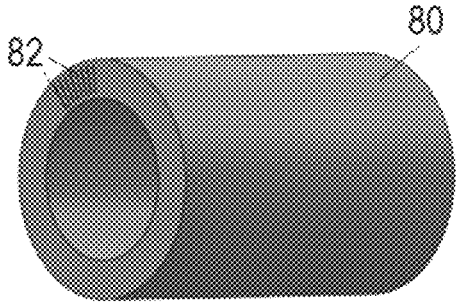
Figure 8D:
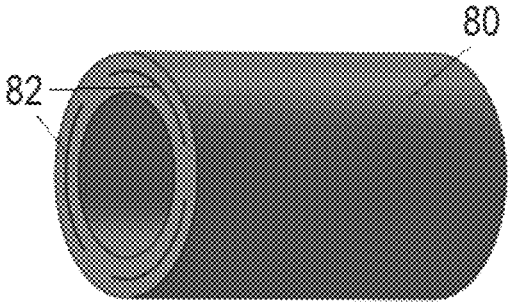

In FIG. 8A, each channel 82 has a circular cross-section, and in FIG. 8B, each channel 82 has an equilateral triangle cross-section. In FIG. 8C, the channels 82 extend radially and have a rectangular cross-section. In FIG. 8D, the channels 82 have rectangular cross-sections that extend circumferentially.

Table 1 shows examples of dimensions of internal channels of a laminar flow modifier, such as the laminar flow device 80. In each configuration, the total flow rate through a set of channels is 0.5 gallons per minute. "Flow rate" is the flow rate through a single channel. A and P are the total area and total wetted perimeter, respectively.

Table 1 shows dimensions for three different circular channel configurations, where "Tube #1" has a single channel, "Tube #2" has 7 channels, and "Tube #3" has 70 channels. Rectangular configurations are denoted as "Slot #1", which has one rectangular channel, and "Slot #2", which has 4 rectangular channels. Two equilateral triangle configurations are denoted as "Triangle #1", which has 64 triangular channels, and "Triangle #2, which has 21 rectangular channels.

TABLE 1

| Tube | Flow rate (gpm) | Da (inch) | Dh (inch) | Specific density | Viscosity cP | Re | Length (inch) @20 psi pressure drop | Channel # | P/A^0.5 |
|---|---|---|---|---|---|---|---|---|---|
| #1 | 0.5 | 0.7 | 0.7 | 1 | 1 | 2260 | 421936.1 | 1 | 3.54 |
| #2 | 0.0714 | 0.1 | 0.1 | 1 | 1 | 2260 | 1230.1 | 7 | 9.38 |
| #3 | 0.00714 | 0.01 | 0.01 | 1 | 1 | 2260 | 1.23 | 70 | 29.65 |

TABLE 1-continued

| Slot | Flow rate (gpm) | Da (inch) | Dh (inch) | Width (inch) | Thick-ness (inch) | Specific density | Viscosity cP | Re | Length (inch) @20 psi pressure drop | Channel # | P/A^0.5 |
|---|---|---|---|---|---|---|---|---|---|---|---|
| #1 | 0.5 | 0.145 | 0.030 | 1.1 | 0.015 | 1 | 1 | 2228 | 22.2 | 1 | 17.36 |
| #2 | 0.125 | 0.070 | 0.028 | 0.26 | 0.015 | 1 | 1 | 2258 | 21.0 | 4 | 17.61 |
| **Equal Lateral Triangle** | **Flow rate (gpm)** | **Da (inch)** | **Dh (inch)** | **Height (inch)** | | **Specific density** | **Viscosity cP** | **Re** | **Length (inch) @20 psi pressure drop** | **Channel #** | **P/A^0.5** |
| #1 | 0.00781 | 0.0086 | 0.0067 | 0.010 | | 1 | 1 | 2241 | 0.44 | 64 | 36.47 |
| #2 | 0.0238 | 0.026 | 0.02 | 0.030 | | 1 | 1 | 2276 | 11.7 | 21 | 20.89 |

As shown in the Table 1, for a pipe with a circular cross-section area, the hydraulic diameter $D_h$ and area equivalent diameter Du are identical. For a rectangular or triangular shape, $D_h$ and Du are different, as such shapes have higher perimeter to area ratios. By separating $D_h$ and $D_a$ in the rectangular or triangular cross-section (or other non-circular cross-section) and selecting the dimensions of the cross-section, the length requirement can be greatly reduced to achieve a desired pressure drop.

As is evident in Table 1, by reducing the diameter of a circular channel (and/or dividing the total area of a channel into multiple smaller channels), the length requirement to achieve laminar flow with a 20 psi pressure drop is significantly reduced.

Table 1 also demonstrates length reduction by providing non-circular channels. As shown, a rectangular or triangular channel is able to achieve laminar flow in a shorter distance as compared to a circular channel. In addition, dividing the total area of a non-circular channel into multiple smaller channels is able to further shorten the distance.

In an embodiment, the geometry of a channel or channels is/are selected so that a ratio of the collective wetted perimeter P, to a square root of the total area A, (cross-sectional geometric area) is greater than a selected threshold ratio. If the laminar flow device includes a single channel, the collective wetted perimeter is the wetted perimeter of the single channel and the total area is the cross-sectional geometric area of the single channel. If the laminar flow device includes a plurality of channels, the collective wetted perimeter is the sum of the wetted perimeters of each channel, and the total area is the sum of the areas of each channel.

For example, the number, size and geometry of the channels are selected to satisfy the following relationship to achieve a length of the laminar flow device that is less than 1200 inches:

$$P_t/(\sqrt{A_t})>10.$$

FIGS. 9A-9B and 10A-10B depict embodiments of a laminar flow device 90. The laminar flow device 90 may be incorporated into the inflow control system 22 (e.g., as the first flow modifier 52 or the second flow modifier 54).

Figures 9A, 9B:
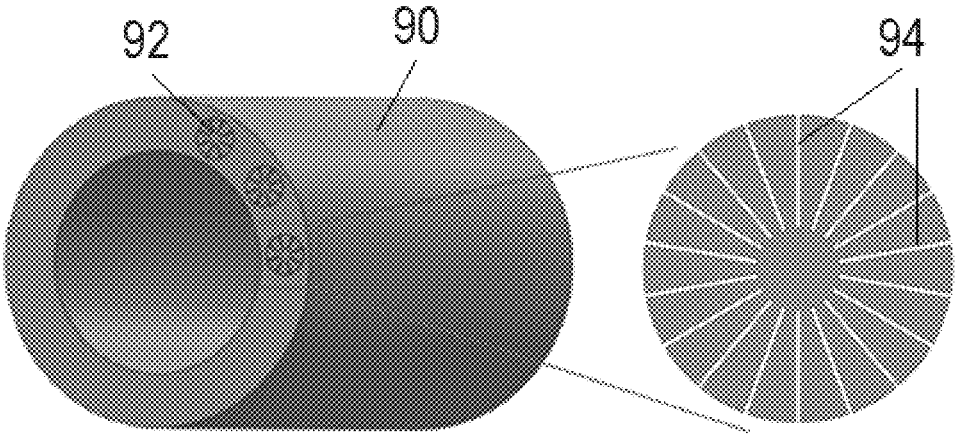
FIGS. 9A and 9B depict an embodiment of a laminar flow modifier having one or more channel structures.

FIG. 9A is a perspective view of the laminar flow device 90 including one or more channel structures 92 arrayed around a central fluid conduit, and FIG. 9B is a close-up cross-sectional view of one of the channel structures. As shown in FIG. 9B, each channel structure 92 includes a plurality of linear rectangular channels 94 extending radially from a central location.

Figures 10A, 10B:
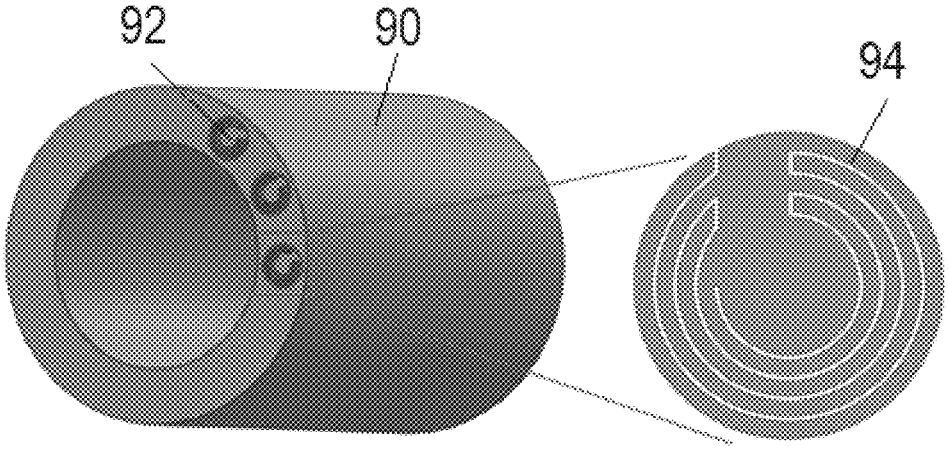
FIGS. 10A and 10B depict an embodiment of a laminar flow modifier having one or more channel structures.

FIG. 10A is a perspective view of the laminar flow device 90 including one or more channel structures 92 arrayed around a central fluid conduit, and FIG. 10B is a close-up cross-sectional view of one of the channel structures. In this embodiment, each channel structure 92 includes a rectangular channel formed by a plurality of interconnected circular channel segments.

Set forth below are some embodiments of the foregoing disclosure:

Embodiment 1: An autonomous inflow control system, comprising: an inlet conduit in fluid communication with a source of a production fluid, the inlet conduit connecting the source of the production fluid to an input of a first flow modifier, the first flow modifier including one of a laminar flow device and a turbulent flow device; an intermediate conduit connected to a first fluid output of the first flow modifier, the intermediate conduit connecting the first flow modifier to a second flow modifier configured to provide a second fluid output, the second flow modifier including another of the laminar flow device and the turbulent flow device; a signal path configured to provide a first signal and a second signal, wherein the first signal corresponds to the first fluid output and the second signal corresponds to the second fluid output, or wherein the first signal corresponds to the input of the first flow modifier and the second signal corresponds to the first fluid output; and a valve responsive to a difference between the first signal and the second signal.

Embodiment 2: The system of any prior embodiment, wherein the first signal is a first pressure signal indicative of a first pressure of the first fluid output, the second signal is a second pressure signal indicative of a second pressure of the second fluid output, and the difference is a pressure difference between the first pressure and the second pressure.

Embodiment 3: The system of any prior embodiment, wherein the first signal is a first pressure signal indicative of a first pressure at the input of the first flow modifier, the second signal is a second pressure signal indicative of a second pressure of the first fluid output, and the difference is a pressure difference between the first pressure and the second pressure.

Embodiment 4: The system of any prior embodiment, wherein the laminar flow device includes an internal fluid conduit, the internal fluid conduit having a geometry and a size selected to cause fluid flow in the internal fluid conduit to transition to a laminar flow within a selected length of the laminar flow device, the internal fluid conduit defining a wetted perimeter and a cross-sectional area, a ratio of the wetted perimeter to a square root of the cross-sectional area being greater than a selected ratio.

Embodiment 5: The system of any prior embodiment, wherein the difference is based on a change in a proportion of a water-based fluid to a hydrocarbon fluid in the production fluid, a ratio of viscosity of the hydrocarbon fluid and the water-based fluid being less than or equal to 10.

Embodiment 6: The system of any prior embodiment, wherein a difference in density between the hydrocarbon fluid and the water-based fluid is greater than or equal to about 10%.

Embodiment 7: The system of any prior embodiment, wherein the signal path includes a first fluid conduit and a second fluid conduit in fluid communication with the valve.

Embodiment 8: The system of any prior embodiment, wherein the valve is a piston valve having a first chamber in fluid communication with the first fluid conduit, and a second chamber in fluid communication with the second fluid conduit.

Embodiment 9: The system of any prior embodiment, wherein the valve is a diaphragm valve.

Embodiment 10: A method of controlling fluid flow, comprising: flowing a production fluid into a first flow modifier via an inlet conduit, the first flow modifier being one of a laminar flow modifier and a turbulent flow modifier; directing a first fluid output of the first flow modifier via an intermediate conduit to a second flow modifier, the second flow modifier in series with the first flow modifier, the second flow modifier including another of the laminar flow device and the turbulent flow device; outputting a second fluid output from the second flow modifier; directing a first pressure signal via a first signal path to a valve; directing a second pressure signal via a second signal path to the valve, wherein the first pressure signal corresponds to the first fluid output and the second pressure signal corresponds to a second fluid output from the second flow modifier, or wherein the first pressure signal corresponds to the input of the first flow modifier and the second pressure signal corresponds to the first fluid output; and automatically opening or closing the valve responsive to a pressure difference between the first pressure signal and the second pressure signal.

Embodiment 11: The method of any prior embodiment, wherein the pressure difference is based on a change in a proportion of a water-based fluid to a hydrocarbon fluid in the production fluid, a ratio of viscosity of the hydrocarbon fluid and the water-based fluid being less than or equal to 10.

Embodiment 12: The method of any prior embodiment, wherein a difference in density between the hydrocarbon fluid and the water-based fluid is less than or equal to about 10%.

Embodiment 13: The method of any prior embodiment, wherein the first signal path includes a first fluid conduit and a second fluid conduit in fluid communication with the valve.

Embodiment 14: The method of any prior embodiment, wherein the valve is one of a diaphragm valve and a piston valve, the piston valve having a first chamber in fluid communication with the first fluid conduit, and a second chamber in fluid communication with the second fluid conduit, and automatically opening or closing the valve includes moving a piston or a diaphragm responsive to the pressure difference.

Embodiment 15: The method of any prior embodiment, wherein the piston or the diaphragm is moved to a closed position responsive to an increase in a proportion of a water-based fluid to a hydrocarbon fluid in the production fluid.

Embodiment 16: A borehole system comprising: a borehole in a subsurface formation; a string in the borehole; and an autonomous inflow control system, comprising: an inlet conduit in fluid communication with a production fluid in the subsurface formation, the inlet conduit connecting the subsurface formation to an input of a first flow modifier, the first flow modifier including one of a laminar flow device and a turbulent flow device; an intermediate conduit connected to a first fluid output of the first flow modifier, the intermediate conduit connecting the first flow modifier to a second flow modifier configured to provide a second fluid output, the second flow modifier including another of the laminar flow device and the turbulent flow device; a signal path configured to provide a first pressure signal and a second pressure signal, wherein the first pressure signal corresponds to a first pressure of the first fluid output and the second pressure signal corresponds to a second pressure of the second fluid output, or wherein the first pressure signal corresponds to the input of the first flow modifier and the second pressure signal corresponds to the first fluid output; and a valve responsive to a pressure difference between the first pressure signal and the second pressure signal.

Embodiment 17: The borehole system of any prior embodiment, wherein the first pressure is a first pressure drop that occurs as the production fluid flows through the first flow modifier, and the second pressure is a second pressure drop that occurs as the first fluid output flows through the second flow modifier.

Embodiment 18: The borehole system of any prior embodiment, wherein the signal path includes a first fluid conduit and a second fluid conduit in fluid communication with the valve.

Embodiment 19: The borehole system of any prior embodiment, wherein the valve is a piston valve having a first chamber in fluid communication with the first fluid conduit, and a second chamber in fluid communication with the second fluid conduit.

Embodiment 20: The borehole system of any prior embodiment, wherein the piston is configured to move to a closed position responsive to an increase in a proportion of a water-based fluid to a hydrocarbon fluid in the production fluid.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An autonomous inflow control system, comprising:

an inlet conduit in fluid communication with a production fluid conduit, the inlet conduit connecting the production fluid conduit to an input of a first flow modifier, the first flow modifier including one of a laminar flow device and a turbulent flow device;

an intermediate conduit connected to a first fluid output of the first flow modifier, the intermediate conduit connecting the first flow modifier to a second flow modifier configured to provide a second fluid output, the second flow modifier including another of the laminar flow device and the turbulent flow device;

an outlet conduit connecting the second fluid output to the production conduit;

a first signal path configured to provide a first pressure signal and a second signal path configured to provide a second pressure signal, wherein the first pressure signal corresponds to a first pressure of a first fluid flow through the intermediate conduit from the first fluid output and the second pressure signal corresponds to a second pressure of a second fluid flow through the outlet conduit from the second fluid output, or wherein the first pressure signal corresponds to a third pressure of a third fluid flow through the inlet conduit and the second pressure signal corresponds to the first pressure of the first fluid flow through the intermediate conduit from the first fluid output; and a valve responsive to a difference between the first pressure signal and the second pressure signal.

2. The system of claim 1, wherein the first signal path includes a first fluid conduit connecting the intermediate conduit to the valve, and the second signal path includes a second fluid conduit connecting an outlet of the second flow modifier to the valve.

3. The system of claim 1, wherein the first signal path includes a first fluid conduit connecting the inlet conduit to the valve, and the second signal path includes a second fluid conduit connecting the intermediate conduit to the valve.

4. The system of claim 1, wherein the laminar flow device includes an internal fluid conduit, the internal fluid conduit having a geometry and a size selected to cause fluid flow in the internal fluid conduit to transition to a laminar flow within a selected length of the laminar flow device, the internal fluid conduit defining a wetted perimeter and a cross-sectional area, a ratio of the wetted perimeter to a square root of the cross-sectional area being greater than a selected ratio.

5. The system of claim 1, wherein the difference is based on a change in a proportion of a water-based fluid to a hydrocarbon fluid in the production fluid, a ratio of viscosity of the hydrocarbon fluid and the water-based fluid being less than or equal to 10.

6. The system of claim 5, wherein a difference in density between the hydrocarbon fluid and the water-based fluid is greater than or equal to about 10%.

7. The system of claim 1, wherein the first signal path includes a first fluid conduit and the second signal path includes a second fluid conduit in fluid communication with the valve.

8. The system of claim 7, wherein the valve is a piston valve having a first chamber in fluid communication with the first fluid conduit, and a second chamber in fluid communication with the second fluid conduit.

9. The system of claim 1, wherein the valve is a diaphragm valve.

10. A method of controlling fluid flow, comprising:

flowing a production fluid from a production conduit into a first flow modifier via an inlet conduit, the first flow modifier being one of a laminar flow device and a turbulent flow device;

directing a first fluid output of the first flow modifier via an intermediate conduit to a second flow modifier, the second flow modifier in series with the first flow modifier, the second flow modifier including another of the laminar flow device and the turbulent flow device;

outputting a second fluid output from the second flow modifier;

directing the second fluid output to the production conduit via an outlet conduit;

directing a first pressure signal via a first signal path to a valve;

directing a second pressure signal via a second signal path to the valve, wherein the first pressure signal corresponds to a first pressure of a first fluid flow through the intermediate conduit from the first fluid output and the second pressure signal corresponds to a second pressure of a second fluid flow through the outlet conduit from the second fluid output, or wherein the first pressure signal corresponds to a third pressure of a third fluid flow through the inlet conduit and the second pressure signal corresponds to the first pressure of the first fluid flow through the intermediate conduit from the first fluid output; and automatically opening or closing the valve responsive to a pressure difference between the first pressure signal and the second pressure signal.

11. The method of claim 10, wherein the pressure difference is based on a change in a proportion of a water-based fluid to a hydrocarbon fluid in the production fluid, a ratio of viscosity of the hydrocarbon fluid and the water-based fluid being less than or equal to 10.

12. The method of claim 11, wherein a difference in density between the hydrocarbon fluid and the water-based fluid is less than or equal to about 10%.

13. The method of claim 10, wherein the first signal path includes a first fluid conduit and the second signal path includes a second fluid conduit in fluid communication with the valve.

14. The method of claim 13, wherein the valve is one of a diaphragm valve and a piston valve, the piston valve having a first chamber in fluid communication with the first fluid conduit, and a second chamber in fluid communication with the second fluid conduit, and automatically opening or closing the valve includes moving a piston or a diaphragm responsive to the pressure difference.

15. The method of claim 14, wherein the piston or the diaphragm is moved to a closed position responsive to an increase in a proportion of a water-based fluid to a hydrocarbon fluid in the production fluid.

16. A borehole system comprising:

a borehole in a subsurface formation;

a string in the borehole; and an autonomous inflow control system, comprising:

an inlet conduit in fluid communication with a production fluid conduit, the inlet conduit connecting the production fluid conduit to an input of a first flow modifier, the first flow modifier including one of a laminar flow device and a turbulent flow device;

an intermediate conduit connected to a first fluid output of the first flow modifier, the intermediate conduit connecting the first flow modifier to a second flow modifier configured to provide a second fluid output, the second flow modifier including another of the laminar flow device and the turbulent flow device;

an outlet conduit connecting the second fluid output to the production conduit;

a first signal path configured to provide a first pressure signal and a second signal path configured to provide a second pressure signal, wherein the first pressure signal corresponds to a first pressure of a first fluid flow through the intermediate conduit from the first fluid output and the second pressure signal corresponds to a second pressure of a second fluid flow through the outlet conduit from the second fluid output, or wherein the first pressure signal corresponds to a third pressure of a third fluid flow through the inlet conduit and the second pressure signal corresponds to the first pressure of the first fluid flow through the intermediate conduit from the first fluid output; and a valve responsive to a pressure difference between the first pressure signal and the second pressure signal.

17. The borehole system of claim 16, wherein the first pressure is a first pressure drop that occurs as the production fluid flows through the first flow modifier, and the second pressure is a second pressure drop that occurs as the first fluid output flows through the second flow modifier.

18. The borehole system of claim 16, wherein the first signal path includes a first fluid conduit and the second signal path includes a second fluid conduit in fluid communication with the valve.

19. The borehole system of claim 18, wherein the valve is a piston valve having a first chamber in fluid communication with the first fluid conduit, and a second chamber in fluid communication with the second fluid conduit.

20. The borehole system of claim 19, wherein the piston is configured to move to a closed position responsive to an increase in a proportion of a water-based fluid to a hydrocarbon fluid in the production fluid.

* * * * *